US006688973B2

(12) United States Patent
Satloff et al.

(10) Patent No.: US 6,688,973 B2
(45) Date of Patent: Feb. 10, 2004

(54) SYSTEM FOR USING TRADING CARDS INTERACTIVELY THROUGH AN ELECTRONIC NETWORK

(76) Inventors: James E. Satloff, 300 Central Park West, Apt. 20G, New York, NY (US) 10024-1513; Dustin N. Satloff, 300 Central Park West, Apt. 20G, New York, NY (US) 10024-1513

( * ) Notice: Subject to any disclaimer, the term of this patent is extended or adjusted under 35 U.S.C. 154(b) by 46 days.

(21) Appl. No.: 10/005,922

(22) Filed: Nov. 20, 2001

(65) Prior Publication Data

US 2003/0107173 A1 Jun. 12, 2003

(51) Int. Cl.[7] ..... A63F 1/00

(52) U.S. Cl. ..... 463/1; 463/42; 273/244.2; 273/237; 273/292; 273/298; 273/308

(58) Field of Search ..... 273/138.1, 138.2, 273/139, 237, 238, 244.1, 244.2, 292, 293, 298, 308; 463/1–5, 42

(56) References Cited

U.S. PATENT DOCUMENTS

| | | | | | |
|---|---|---|---|---|---|
| 5,145,173 | A | | 9/1992 | Crowder | 273/93 |
| 5,407,204 | A | | 4/1995 | Meyer, III | 273/244 |
| 5,411,259 | A | * | 5/1995 | Pearson et al. | 273/93 |
| 5,533,124 | A | | 7/1996 | Smith et al. | 380/4 |
| 5,671,555 | A | * | 9/1997 | Fernandes | 40/124.03 |
| 5,689,561 | A | | 11/1997 | Pace | 380/4 |
| 5,748,731 | A | | 5/1998 | Shepherd | 380/4 |
| 5,779,549 | A | | 7/1998 | Walker et al. | 463/42 |
| 5,954,332 | A | * | 9/1999 | Mero et al. | 273/236 |
| 5,964,660 | A | | 10/1999 | James et al. | 463/1 |
| 6,061,656 | A | | 5/2000 | Pace | 705/1 |
| 6,106,399 | A | | 8/2000 | Baker et al. | 463/42 |
| 6,200,216 | B1 | * | 3/2001 | Peppel | 463/1 |
| 6,224,486 | B1 | | 5/2001 | Walker et al. | 463/42 |
| 6,240,415 | B1 | | 5/2001 | Blumberg | 707/9 |
| 2003/0054885 | A1 | * | 3/2003 | Pinto et al. | 463/42 |

* cited by examiner

*Primary Examiner*—Benjamin H. Layno
(74) *Attorney, Agent, or Firm*—Milde & Hoffberg, LLP

(57) ABSTRACT

A system for using trading cards interactively through an electronic network, such as the Internet, combines uniquely identified trading cards with specially designed electronic services. Each trading card, which designates a game player, such as a sports talent, has associated therewith a unique identifier of alphanumeric characters. The game playing rights to a subset of these trading cards is sold to a plurality of card collectors, the game players designated by the cards of each subset forming a game playing "team" to be managed by the respective card collector. The collector registers selected ones of the cards from his/her subset of cards with a game service provider, thus placing the game players designated by the selected cards "in play". Thereafter, the game service provider determines current information about each game player in play and advances the status of the game between the collectors whose game players are in play in accordance with the current information and in accordance with the rules of the game. The collectors can change the selected ones of the cards which are registered with the game service provider in an attempt to improve their chances of winning a game.

12 Claims, 2 Drawing Sheets

SYSTEM FOR USING TRADING CARDS INTERACTIVELY THROUGH AN ELECTRONIC NETWORK

BACKGROUND OF THE INVENTION

The present invention relates to a system (method and apparatus) for using "trading cards" interactively through an electronic network, such as the Internet.

The present invention utilizes trading cards in interactive, on-line game playing, in a way which heightens interest in the cards, the associated electronic venues, and the actual sport or theme represented by the cards.

For the purposes of the present disclosure, the term "trading card" shall mean a physical card, made of cardboard, plastic or the like, a "virtual" card, presented as an image to the user by electronic and/or optical means, or some other physical substrate or virtual image, which bears text and/or graphic information about a certain a sport (baseball, basketball, football, hockey, etc.), for which the player's statistics and current actual performance are known.

The trading card industry, currently dominated by sports cards, has existed for over 100 years and has seen significant changes over that period. Initially popularized by cigarette companies, a number of producers of trading cards exist. The primary producers of sports trading cards are Topps (topps.com), Fleer (fleer.com), and Upper Deck (upperdeck.com). Many other producers also exist, and the themes of their trading cards are not limited to sports.

The trading card industry has become extremely competitive. Over the years, it has embraced new printing technologies, new themes, new sports, new packaging ideas, and other innovations such as actual player autographs and embedding small fragments of game-used equipment in the cards, to achieve competitive advantage. The industry has not, however, significantly successfully embraced the new electronic networking or Internet technologies in its search for innovation and competitive advantage.

One use of the Internet involving so-called electronic cards or "e-cards", allows a card holder to visit a world-wide-web site, enter a code number from a special, limited-production sports trading card, and learn whether he or she is entitled to a prize or an "upgraded" card. Another use of the Internet allows collectors to purchase "virtual" cards which are held by the producer. Since pristine condition is generally required for a card to maintain its maximum monetary value, trading card companies have offered a service whereby a collector can purchase the "deed" to a card on-line. The card is retained in an electronic "vault" for safekeeping. The deeded card can then later be delivered on demand to the owner, or more likely, traded or sold to another collector (without the need to actually physically possess the card).

A number of other electronic sports card trading services and secondary trading markets exist as well. Trading cards (sports and otherwise) are routinely bought and sold on electronic auction sites.

One known set of baseball trading cards has the added feature of being part of a role-playing game, where each card owner/participant can be the manager of a baseball team. A pretend baseball game can be played with the aid of a multi-sided die using statistics listed on each trading card to determine the progress of the game. These cards have interest both as trading cards and as part of the role-playing game.

Over the past 20 years or so, various sports (beginning with baseball) have spawned a now-popular pastime known as "rotisserie" or "fantasy" sports leagues. While there are a great number of different variations in the concept, generally, participants (known as "managers") select actual players from across all professional teams of a given sport, and record the rosters of these "fantasy" teams on paper or electronically. By utilizing a player's actual results during actual professional sports contests, fantasy team managers accrue points as well.

For example if a fantasy baseball team manager has selected Derek Jeter of the New York Yankees and Barry Bonds of the San Francisco Giants to be on his or her fantasy team, and if Jeter bats in 2 runs and Bonds bats in 3 runs, in one version of the game that manager would score 5 points, based upon the actual real time performance of the players. There are innumerable variations of scoring and complexity among these leagues, and the example just stated has been simplified for purposes of explanation.

The rise of the Internet has made operating and participating in fantasy sports leagues much easier and much more popular. Many sites exist (some cost free and some which require a participant to pay for the service) that tabulate all of the statistics on a real time or near-real time basis so that enthusiasts can always see how their fantasy team is performing, compared with other teams which might be constructed by their friends, colleagues, or strangers. In general, each player is given a dollar value and, through pari-mutuel trading activity, their values vary. Each player starts with a certain amount of fantasy money in order to staff the team rosters through either a "draft" of players or through pari-mutuel purchase.

In addition to the above, the following U.S. patents disclose various games and specific uses of trading cards:

The U.S. Pat. No. 6,200,216 to Peppel entitled "Electronic Trading Card" discloses a trading card with an electronic, updateable storage medium, on the card itself. The updatable medium is physically similar in many respects to that used on the New York City Metropolitan Transit Authority's "MetroCard". The card stores electronic information on this medium which includes "multimedia data" such as pictures, sound and text, as well as various other items of information, as desired. These cards may be sold to, and thereafter traded by collectors who may also store their unique password on the updateable medium. These cards are said to be useful for game playing.

The U.S. Pat. No. 5,411,259 to Pearson for a "Video Sports Game System Using Trading Cards" discloses a closed-system video game that uses both human and machine-readable data printed on trading cards. The card-holder can play a game with the cards, either alone or with other players.

The U.S. Pat. No. 5,145,173 to Crowder discloses a "baseball game" which is played with baseball type player trading cards. The game uses physical baseball cards, a die and a deck of standard playing cards. The trading cards are divided into teams, each with a pitcher. The die is tossed to determine which matrix (player or pitcher) is used and a standard playing card is selected to determine which cell in the matrix creates the play.

The U.S. Pat. No. 5,407,204 to Meyer, III discloses a board game for simulating the game of baseball in which baseball trading cards are utilized as playing pieces. The game includes a board having a baseball diamond pictured thereon and a plurality of cardholders into which baseball trading cards may be positioned. A deck of pitcher cards provides a random pitch to a player at bat, such as a strike, ball, or hit, and a deck of action cards provides a random result of the batter's action, such as a hit, out, or homerun. The game pieces are then moved in accordance with the rules of conventional baseball.

The U.S. Pat. No. 5,533,124 to Smith et al. discloses an electronic trading card system wherein trading card software is stored on a removable medium, such as a CD-Rom, in a copy protected form. The trading card software includes trading card data and an executable computer program. Each removable medium contains trading card data that is specific to a particular individual or character or any person, place or thing. The trading card software is interactive. The computer user is able to select one of a number of predetermined displays by selecting interactivity areas on each display.

The U.S. Pat. No. 5,689,561 to Pace and U.S. Pat. No. 6,061,656 to Pace disclose a computer-based trading card collection system using CD-ROMs. The collection items (or more specifically their unlocking keys) are contained in various floppy disks. With the disks inserted into the computer system, the icons of the collection items on the disks appear on the computer monitor. By (double) clicking on the icon, the unlocking key unlocks the corresponding collection item in the CD-Rom program into the hard drive and at the same time the unlocking key is rendered inoperative. A generally reverse process is used to lock the collection item relative to the hard drive and to render the unlocking key operative. The user collects the collection items by unlocking, using a number of floppy disks, the locks in his/her CD-Rom program, which contains the corresponding locks for all of the collection items in the set. When the entire set, or a predetermined subset thereof, has been collected, the CD-Rom program allows the user to play an interactive game related to the collection items.

The U.S. Pat. No. 5,748,731 to Shepherd discloses electronic trading cards composed of a plurality of individual trading card files encoded on a single data storage device, such as a computer diskette or laser disk, each with an associated deciphering key code for deciphering encrypted data in the individual trading card files, and each with a file transfer code which allows individual trading card files to be transferred from one collector to another, without the transferring collector retaining a copy for his or her own use after a transfer is made. The electronic trading cards are organized and viewed using an electronic binder that provides full-featured database functions such as sorting, graphic presentation and the like. The data storage device includes a copy protection code which allows the files on the data storage device to be copied a fixed number of times (e.g., once or twice).

The U.S. Pat. No. 5,779,549 to Walker et al. and the U.S. Pat. No. 6,224,486 to Walker et al. disclose a "database driven online distributed tournament system" in which a number of remotely located players participate in a tournament through input/output devices connected to a central controller which manages the tournament. The game playing method includes the steps of (a) uniquely identifying a player communicating with the central controller via an associated input/output device; (b) responding to payment of an entry fee by the player for allowing the player to participate in a tournament occurring within a fixed time window via an associated input/output device; (c) accessing a database to store in the database player information that is generated as the player participates in the tournament; and (d) awarding the player a prize for achieving a pre-established performance level in the tournament.

The U.S. Pat. No. 5,964,660 to James et al. discloses a multi-player computer game that is played over a computer network. When the game is played via the Internet, players are able to input moves and be apprised of the state of the game using basic input/output functions of their web browser. This game does not make use of trading cards.

The U.S. Pat. No. 6,106,399 to Baker et al. discloses the use of client and server software, communicating with each other via the Internet, to create and maintain a multi-user role-playing game. The virtual world of the game is presented to each user by means of text and dimensional audio. The software reacts to user inputs to make the virtual world change according to user actions.

Finally, the U.S. Pat. No. 6,240,415 to Blumberg discloses a "corporate and entertainment management interactive system using a computer network". The system provides a game of corporate, business or sports management. For instance, in sports management, the data of a player, together with a historical database related to that player, and decisions are communicated between a central database processing resource and at least one remote party. A remote party is permitted to access the database and access designated data from the database. Voting, and other management of a player, team or business is possible in substantially real time or near real time by the remote party. The remote user can vote on financial compensation for a player, a coach or a team and/or for a bonus for a player, team or game. Similarly, hiring and firing decisions can be made.

SUMMARY OF THE INVENTION

It is a principal object of the present invention to provide a method, and also apparatus, which utilizes trading cards in an interactive, online game through an electronic network, such as the Internet.

It is a further object of the present invention to provide a game which can heighten interest in sports trading cards as well as in the actual sport or theme represented by and depicted on the cards.

These objects, as well as further objects which will become apparent from the discussion that follows, are achieved, in accordance with the present invention, by a game playing method which uses a plurality of trading cards, each identifying a "game player"for a specific sport and having a unique identifier of alphanumeric characters associated therewith.

As used hereinafter, the term "game player" is intended to mean and include a real, live person designated (e.g., depicted) by a trading card, who is actively engaged in playing a sport.

In the game, a set of physical trading cards is offered for sale to collectors. Various groups of these cards may designate the same game player but each card in each group has a different and unique identifier.

At least the game playing rights, if not the physical chattel itself, of a subset of this set of trading cards, is then purchased by each of a plurality of card collectors. The game players designated by the cards of each subset form a game playing "team" to be managed by the respective card collector.

Thereafter, the collectors/card owners register with a game service provider selected ones of the cards from his/her subset of cards, thereby to place the game players designated by these selected cards "in play".

Next, current information about each game player in play is determined by the game service provider and the status of the game between collectors, whose game players are in play, is advanced in accordance with the current information about each game player in play and in accordance with the rules of the game.

For continued play, each collector can "manage" his/her team by changing the selected cards which are registered with the game service provider in an attempt to improve the chances of winning the game or future games.

In its most basic form, the present invention thus combines uniquely identified trading cards with specially designed electronic services which may include Internet web sites.

Collectors of these specially identified cards (which could be distributed as special "insert" cards in ordinary packs or as packs containing only this type of card) are encouraged to enter the unique alphanumeric identifiers of their cards via the Internet (or other computer network), thus "registering" them with a game service operated either by the sports card producer itself or a third party service provider. Once a requisite number of cards is registered, the collector can play interactive games against acquaintances or other unknown collectors around the world.

Since each card number is unique, and describes a particular card (for example, in a baseball embodiment of this invention, there may be 1,000 "unique" Barry Bonds cards in a given series), it is possible for the computer service to verify that the card is actually held by the collector who has registered it. Such registration could be changed as the result of a trade between collectors, but in no case can more than one collector have the same unique card registered simultaneously.

Interactive games such as fantasy sports teams can be played easily and with much enjoyment by collectors of these cards. Continuing with one version of the baseball embodiment as an example, once a collector has amassed enough cards to have at least one player for each of the nine positions of a baseball team, and has registered them with the game service, that collector can begin following the results of his or her virtual baseball team. The statistics for this team are automatically calculated and tabulated by the service (this facility exists today for a great many fantasy sports leagues), so that the collector can review the standings of his or her team throughout the actual baseball season, making trades and modifying the player line-up of the team, acting as a manager of the virtual team. Collectors can trade with each other by changing the registered "owner" of each card on-line. Divisions of teams can be constructed at random or by affiliations. For example, classmates at school could construct their own divisions on-line. Co-workers could create a division for their company. Competition could be for fun or for sponsored prizes as well.

Baseball and other fantasy sports leagues thus contemplated by the present invention. As may be seen, the present invention references the real time performance of currently active sports players.

A number of embodiments are possible that allow interactive gaming based on the concept of unique card identifiers. Automated methods for inputting the unique identifiers, such as using barcodes and inexpensive card readers through which the cards may be "swiped" to register their numbers, are contemplated by the present invention although the invention is in no way limited to the use of such techniques.

For a full understanding of the present invention, reference should now be made to the following detailed description of the preferred embodiments of the invention as illustrated in the accompanying drawings.

DESCRIPTION OF THE PREFERRED EMBODIMENTS

The preferred embodiments of the present invention will now be described with reference to FIGS. 1 and 2 of the drawings.

The present invention utilizes a combination of uniquely numbered trading cards and specially designed electronic services, including Internet web-sites and the associated system, for administering interactive game play or other pursuits.

Figure 1A:
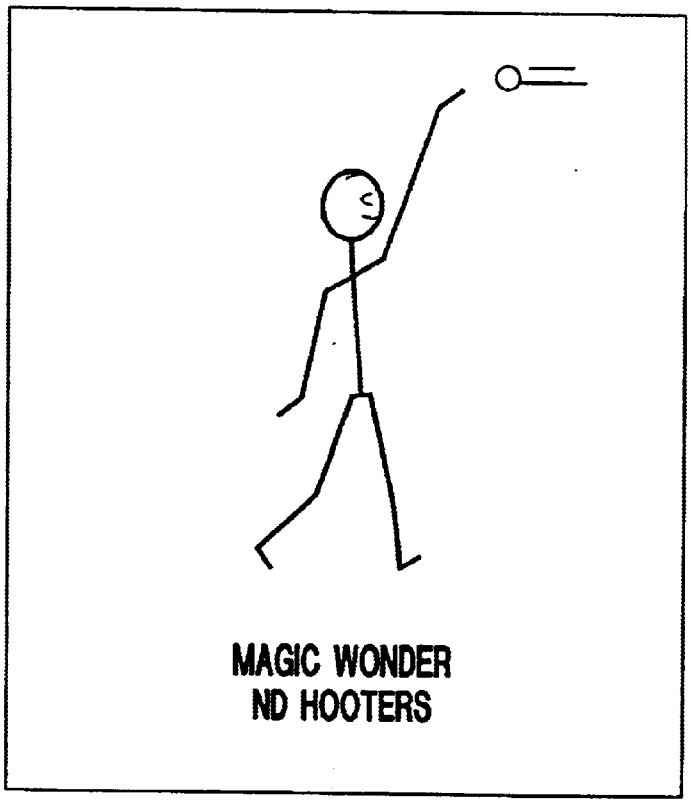
FIGS. 1A and 1B depict the front and back of a typical trading card, which bears a unique sequence of alphanumeric characters in accordance with the present invention.
Figure 1B:
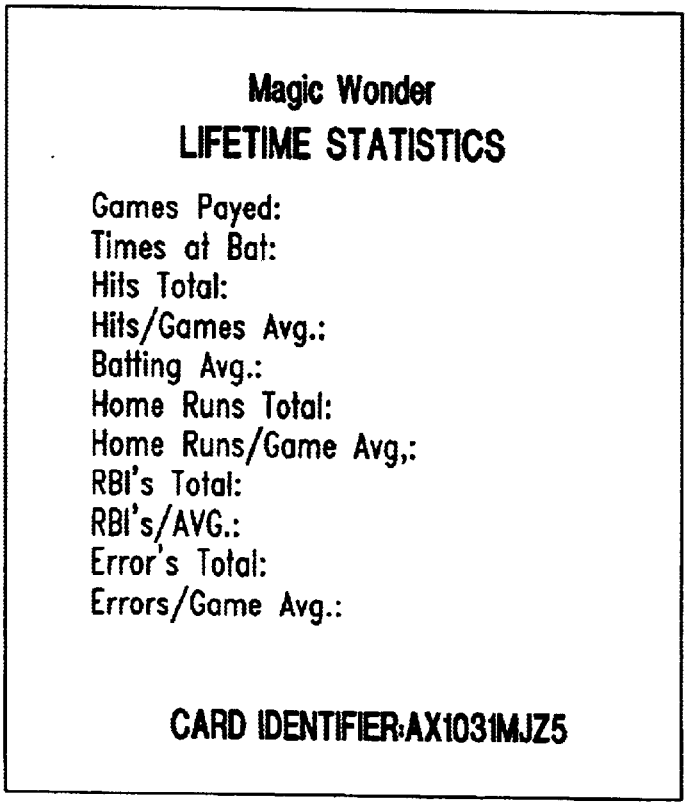

FIGS. 1A and 1B illustrate the front and back, respectively, of a typical trading card which may be used in accordance with the present invention. It will be understood that this card is a "physical card"—that is, chattel—or it may be a virtual card which is presented electronically as an optical image, for example on a computer screen. In any case, this card should have the "look and feel" of a conventional trading card when in use.

In this example, the card depicts and describes a baseball player called "Magic Wonder" who currently plays for the team of the "North Dakota Hooters". Although both the players and team are fictitious, the actual trading cards used in practice of the invention will depict real players actively engaged in a real sport, such as baseball, football, basketball, hockey, etc., for which player's statistics are known. As is conventional for baseball trading cards, the picture of the "talent" is depicted on the front of the card (Fig. 1A) and the current statistics (at the time the trading card is produced) concerning this talent are set forth on the back (FIG. 1B).

Associated with this card, and printed either on the front or the back thereof, is a "card identifier"; that is, a unique sequence of alphanumeric characters. In this case, the identifier is: AX1031MJZ5.

The unique identifier for this card may be printed on the card, represented on the card in optically readable form as a bar code, represented on the card in magnetically readable form as a magnetic stripe, represented electronically in the memory of a microchip embedded in the card, or two or more of the above.

It will be understood that a collector who wishes to add "Magic Wonder" to his or her fictitious baseball team need only purchase the "game playing rights" to this card, or another card depicting Magic Wonder which has another card identifier. It is not necessary for the collector to actually possess this card or even own the physical chattel itself, although the most common usage may indeed be to possess both the physical card and game-playing rights simultaneously. The game playing rights may be sold separately from the physical or virtual card.

Figure 2:
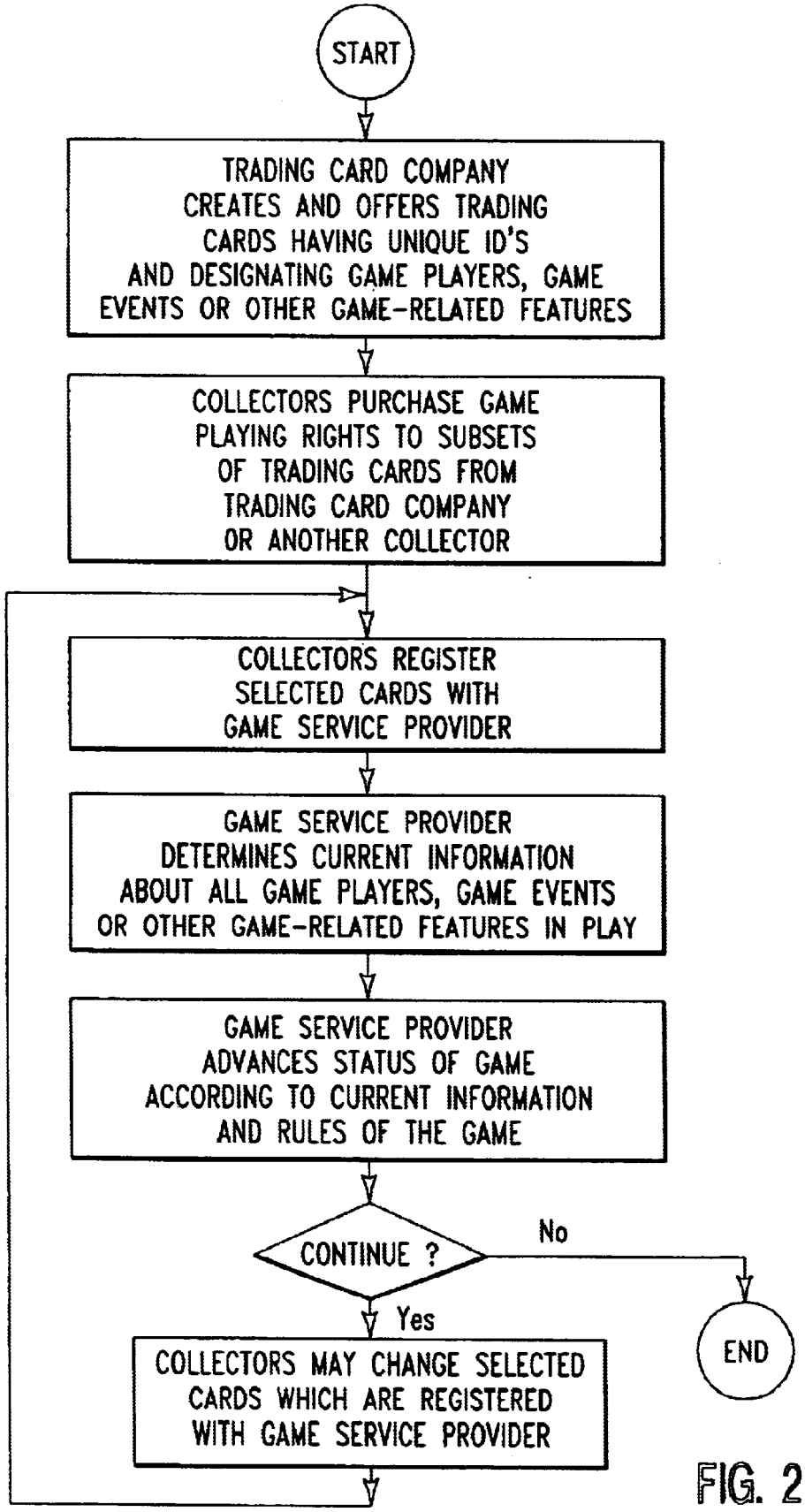
FIG. 2 is a flow chart depicting the sequence of play in the game method according to the present invention.

The game playing method is outlined in FIG. 2. To establish a game, a trading card company must first create and offer trading cards which designate the players (e.g., baseball players) of the game. As explained above, each card must have a unique identifying sequence of alphanumeric characters which are maintained on the ownership records of the trading card company.

The trading card company will normally offer more than one trading card for each game player, although each card will have a unique identifier. For example, there may be 1000 or more cards designating "Magic Wonder" as a game player. For the game of baseball, it is necessary for the trading card company to offer cards designating a plurality of players for each of the nine baseball game positions; i.e., pitcher, catcher, first baseman, etc.

The trading card company may offer the actual physical trading cards, or they may simply offer to sell the game playing rights to each card. Collectors may then purchase the physical or virtual trading cards, which incorporate the game playing rights thereto or, as a minimum, the collectors may merely purchase the game playing rights to these cards. Either way, the collectors may purchase the cards with the game playing rights, or purchase the game playing rights alone, from either a trading card company or from another collector. If purchased from another collector, the "deed" must be registered with the trading card company so that it can update its ownership records.

In order to play a game, a collector must purchase (as a minimum) game playing rights to a subset of trading cards so that he/she can field a "team" of game players. Thus, in the baseball example, the collector must, as a minimum, purchase game playing rights to nine cards, the cards designating game players for each of the nine baseball positions. Normally, however, the collector will purchase more than one card designating game players for each of the nine positions so that he/she may substitute game players during or between games.

The first thing a collector must do to play a game is to register his/her selected cards with a game service provider. This game service provider may be the trading card company or an independent third party which operates under contract with the trading card company to host the interactive trading card games. In order to register, the collector first submits his/her name and password, which must match the names and passwords which are stored by the game service provider for all of the pre-registered collectors. Thereafter, the collector enters the sequence of alphanumeric characters of the unique identifier on each card which he/she wishes to use in playing the game. Presumably, to do so, the collector must select those cards from among a larger number of cards which he/she owns (or for which the game playing rights are owned).

Since the ownership records of the trading cards are maintained at the trading card company, the game service provider must have access to these records when accepting registrations. Only those cards whose game playing rights are owned by the collector seeking to register the card will be accepted in playing a game.

The game service provider may, of course, charge a flat fee or annual fee for membership, or may charge a fee to the collector each time a game is played. The game service provider may also charge no fee since the trading card company has already received a fee when the trading card was originally purchased by the collector.

In order to play a game, the game service provider must determine current information about all the game players in play. In the baseball example referred to above, the game service provider will maintain current baseball "stats" on "Magic Wonder" and all of the other players designated by trading cards which have been registered for play.

The game service provider then advances the status of the game according to the current information about the registered game players therein, and according to the rules of the game (e.g., the rules of fantasy baseball). The outcome of the game thus depends upon how the actual (e.g., baseball) game players are performing in real life.

Using this process, the game service provider determines the winner of a game and awards winning points to the collector whose team has won the game, or accrues points for that collector for an entire season of play or subset thereof.

From time to time, the collectors may be asked to decide, e.g., via computer terminal, whether they wish to continue to play the game or to play another game. If not, the process is ended.

If two or more collectors wish to continue to play another game, or if the current game spans multiple days, weeks or months, they may either retain all the game players on their present team (which a collector might wish to do if he/she won the previous game or is winning the current game) or they may change one or more game players on their team by changing the selected cards which are registered with the game service provider. Collectors may change their players, provided that they have the game-playing rights to each card they wish to "play", by duly registering these cards with the game service. In this way, the collectors can "manage" their team to play the game most effectively.

Unique Numbering to Ensure One User per Card: As explained above, the technology already exists to produce trading cards, each uniquely numbered. This printing technology, however, is insufficient to achieve the aim described above. For example (again using the baseball and fantasy sports league embodiment) if a trading card producer numbered the cards sequentially (say 1,000 Mark McGwire cards each numbered from 0001 to 1000) it would be relatively easy for an imposter to "register" cards that he/she did not have, by merely entering a guessed number from the sequence, repeatedly, until the number from a McGwire card that had not yet been registered was found. If a pack of cards with the "pirated" number were purchased and registration were attempted, it would be refused, since it had already been registered by the imposter who neither bought the product nor traded for it. A more sophisticated numbering scheme is therefore desirable. According to the invention, a non-sequential series of alphanumeric characters are used in order to increase greatly the number of possible combinations for a specific identifier length. In addition, a "check-sum" figure is preferably embedded in the coding in order to defeat hackers. A very simple example of an embedded check-sum appears below.

Collectors of these specially numbered cards (which may be distributed as special "insert" cards in ordinary packs or as packs containing only this type of card) could enter the unique numbers of their cards via the Internet (or other computer network), "registering" them with a service operated either by the sports card producer itself or a third party service provider. Once a requisite number of cards is registered, the collector can play interactive games against acquaintances or other unknown collectors around the world.

Simple Check-Sum to Ensure No Guessing or Pirating of Card Identities: The example set forth below has three simple validity checks. It is provided here to demonstrate the complexities and possibilities of unique identifiers, and is not intended to be the sole coding method available to users of the present invention. An identifier made up of six alphanumeric characters (which would be unrealistically small for the invention contemplated) uses a scheme where only those combinations that satisfy a check-sum are considered valid. A representation of the identifier is six boxes in a row (with positions 1–6 noted above).

| 1 | 2 | 3 | 4 | 5 | 6 |
|---|---|---|---|---|---|
| | | | | | |

The check-sum in this simple example is the integer value of the sum of the numeric values for positions 4, 5, and 6, divided by 3. The check-sum is placed in position 1. Further, an alphabetic character, equal to the check-sum plus 2 is placed in position 2. The letter M is always placed in position 3. Thus, '3EM254' is a valid identifier, as it passes all three simple tests (the checksum in position 1 is correct, the alphabetic character is correct, and the letter M is in place).

| 1 | 2 | 3 | 4 | 5 | 6 |
|---|---|---|---|---|---|
| 3 | E | M | 2 | 5 | 4 |

In this basic example, adding one to the digit in position 6, yielding "3EM255" would not yield a valid identifier. Nor would altering any of the alphabetic characters yield a valid identifier. In this way (although using a more sophisticated application) unique identifiers that cannot easily be guessed or hacked may be employed for use with the present invention.

Variable Supply of Certain Cards to Stimulate Interest in Collecting and Purchase: As is the case with current, non-interactive, trading cards, not all card images are plentiful. In fact, in order to stimulate collector interest, it is common practice among trading card producers to ensure that certain cards are produced in extremely limited quantities. This practice may be employed effectively for the purposes of the present invention. Again using the baseball sports embodiment, very few Barry Bonds cards could be produced as a conscious choice by the card producer, assuming that many collectors will buy more of the product in search of this card because of Bond's potential attractiveness to the interactive game or pursuit. New player cards could be released during the season as well. Certain lesser-known players could emerge as popular cards if they are performing well in real life.

Selection of Cards to be Active for a Particular Interactive Game or Task to Ensure Continual Interest:

Using the baseball card and fantasy sports league embodiment as an example, only one shortstop position may be required for an interactive game. However, "Joe" (a theoretical user of the method according to the invention) may have two different shortstop cards that he has registered with the producer's database (as explained below). Joe could designate one of these shortstops as "active" for the specified interactive game, and keep the second one in reserve. In this way, if Joe's selected card is under-performing, he could change the card that is active, within the rules of the interactive game.

Database of Cards to Ensure Single, Authenticated Identities of Cards and Registered Owners: The producer of the game preferably keeps an electronic database of the cards produced, so that when a collector enters the unique identifier, the database software can determine which card has been entered. Advantageously, a likeness of the card may be displayed on the user's computer screen. The registered user's list of valid cards may also be displayed as a convenience. In one preferred embodiment, the registered user that had duplicates of a given card could indicate that he or she wished to trade that card, or in the reverse, a collector's wish list could be posted and matched with the users that maintain duplicates of that card.

Trading of cards (which is the very nature of trading cards) could easily be accomplished by changing the registered owner of the card in the database, using an electronic interface such as an Internet World-Wide-Web page. Adding interest to this process could be a market in which the actual owner of the card deeds only the interactive rights to a card while maintaining ownership and possession of the chattel itself. For example, using the baseball card embodiment as an example once again, if "Joe" owns and has registered two different shortstops (say, for ease of description, Derek Jeter and Nomar Garciaparra), he could trade the interactive rights to one of them to "Mary" (another theoretical user of this invention), by merely transferring the registration for that card. Joe and Mary could agree that Joe could keep the physical manifestations of both the Jeter and Garciaparra cards, but he could only use those cards whose rights he still owned for the interactive game.

Compatibility with Virtual Trading Cards in Order to Provide Flexibility and Secondary Markets: As has been shown in the example of trading only the interactive rights to a trading card, it is clearly possible to divorce the ownership of the physical property from the interactive rights. As such, it is not necessary to have a physical card in the first place. An example of this concept (using the baseball metaphor for consistency only) could involve the situation where a new player, who is performing well in real life, does not yet have a physical card printed. The producer may offer the rights to such a card in advance of its printing. The producer may also decide not to produce a physical manifestation of the card at all, and make the rights available to collectors in a method other than the retail purchase of packs of cards.

Using an Encryption Technology or Specially-designed Barcodes to Conceal the Numbering Scheme: Well known encryption technology and barcode technology may be used in accordance with the present invention to increase security of the alphanumeric identifiers on the cards. While it is not necessary to employ such technologies for the full exploitation of the invention, they may be easily implemented and such technologies might enable speedier and more convenient use of the invention. For example, a collector may "swipe" cards with unique barcodes in a bar code reader, thus entering the identifier in a fail-safe manner, rather than typing the identifier into a web-site.

For purposes of encryption/decryption, the trading card company must provide the service provider with the encryption/decryption key.

Use of Magnetic Strip Technology and Embedded Microchip technology To Enable More Sophisticated Interactivity: A more advanced technique of handling the unique identifiers in trading cards is to embed either a magnetic medium or a microchip in each card as is currently used on credit cards (for the magnetic medium), or as is used on non-U.S. telephone cards and credit cards (for the embedded microchip). The unique identifier can than be entered into a computer via an output device associated with the microchip, in the same manner as on the non-U.S. telephone cards and credit cards.

In conclusion, the present invention provides a novel approach to linking the fun and excitement of purchasing and collecting trading cards of all themes and types, with the interactivity enabled by the new media of the Internet, World-wide-web, and other electronic networks. By employing this invention, which is remarkably simple and easy to do, producers of cards and interactive games and activities may reap the benefits of additional market share and customer visibility.

There has thus been shown and described a novel system for using trading cards which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method of playing a game, using a plurality of trading cards, each card designating a currently living "game player" for a specific sport, who is actively engaged in playing that sport, each card having a unique identifier of alphanumeric characters associated therewith, said method comprising the steps of:

(a) offering for use a limited set of trading cards, each card in the set having associated therewith an identifier of alphanumeric characters which is unique among all the cards in the set, each card also designating a single game player, there being a plurality of said game players designated by said cards in the set, wherein groups of trading cards within said set designate the same game player, with each card within a group having a different identifier of alphanumeric characters, and wherein at least some of said groups of cards have different numbers of cards than other groups of cards;

(b) granting game playing rights to a subset of said set of trading cards to each of a plurality of card collectors, the game players designated by the cards of each subset forming a game playing "team" to be managed by the respective card collector;

(c) registering with a game service provider selected ones of the cards from said subsets of cards, said cards being registered by their respective alphanumeric identifiers to said game provider, the collector of each subset thereby placing the game players designated by the selected ones of the cards "in play";

(d) determining current information about the actual performance of each game player who is in play;

(e) advancing the status of a game between the collectors whose game players are in play in accordance with the current information about such game players and in accordance with rules of the game; and (f) changing the selected ones of the cards which are registered with the game service provider, and thus the game players in play in an attempt to improve the chances of winning a game.

2. The method defined in claim 1, wherein no subset of said set of trading cards has a sequential set of identifiers of alphanumeric characters.

3. The method defined in claim 1, wherein at least one of said groups of cards has a number of cards which is less than the number of cards in each of the remaining groups, thereby increasing the scarcity value of this at least one group.

4. The method defined in claim 3, wherein the number of cards in said at least one group is in the range of 1 –1000.

5. The method defined in claim 1, wherein the identifier of alphanumeric characters for each card includes at least one alphanumeric character which represents a checksum of that identifier.

6. The method defined in claim 1, wherein the identifier on each card is represented in machine-readable form.

7. The method defined in claim 6, wherein the identifier on each card is represented as a bar code.

8. The method defined in claim 6, wherein the identifier on each card is represented as a magnetic stripe.

9. The method defined in claim 6, wherein the identifier on each card is represented in a microchip and wherein said microchip includes output means for reading the identifier.

10. The method defined in claim 1, wherein the identifier on each card is encrypted, and wherein the method further includes the step of providing the game service provider with a decryption key.

11. The method defined in claim 1, wherein the game playing rights to said trading cards are sold to collectors together with their associated physical trading cards.

12. The method defined in claim 1, wherein the game playing right to said trading cards are sold to collectors independent of their associated physical trading cards.

* * * * *